US010207892B2

(12) United States Patent
Wen

(10) Patent No.: US 10,207,892 B2
(45) Date of Patent: Feb. 19, 2019

(54) CABLE REEL FOR AUDIO-VISUAL DEVICE

(71) Applicant: Nzxt Inc., City of Industry, CA (US)

(72) Inventor: Paul Wen, City of Industry, CA (US)

(73) Assignee: NZXT INC., City of Industry, CA (US)

( * ) Notice: Subject to any disclaimer, the term of this patent is extended or adjusted under 35 U.S.C. 154(b) by 123 days.

(21) Appl. No.: 15/337,174

(22) Filed: Oct. 28, 2016

(65) Prior Publication Data

US 2018/0118504 A1 May 3, 2018

(51) Int. Cl.
*B65H 75/44* (2006.01)

(52) U.S. Cl.
CPC ..... *B65H 75/446* (2013.01); *B65H 75/4465* (2013.01); *B65H 75/4476* (2013.01); *B65H 2701/3919* (2013.01)

(58) Field of Classification Search
CPC . B65H 75/242; B65H 75/446; B65H 2701/34
See application file for complete search history.

(56) References Cited

U.S. PATENT DOCUMENTS

2010/0224714 A1* 9/2010 Winther ..... B65H 75/446
242/400.1
2011/0065313 A1* 3/2011 Huang ..... B65H 75/143
439/501
2011/0095119 A1* 4/2011 Thorn ..... B65H 75/143
242/388.1

* cited by examiner

*Primary Examiner* — Sang K Kim
(74) *Attorney, Agent, or Firm* — Muncy, Geissler, Olds & Lowe, P.C.

(57) ABSTRACT

A cable reel for audio-visual device includes an upper base and a lower base attracted to an external device. An audio-visual device hangs on a top of the lower base. The upper base cooperates with the lower base whereby connection cables are spooled and accommodated in an upper circular groove of the upper base and a lower circular groove of the lower base. The present invention places the audio-visual device so that a user can easily spool connection cables of the audio-visual device with one hand. Once the audio-visual device is not needed, the user can rapidly and conveniently manage cables and place the audio-visual device without worrying about the inner breaking of the connection cables resulted from entangling the connection cables.

9 Claims, 12 Drawing Sheets

CABLE REEL FOR AUDIO-VISUAL DEVICE

BACKGROUND OF THE INVENTION

Field of the Invention

The present invention relates to a reel, particularly to a cable reel for an audio-visual device reeling cables of the audio-visual device, wherein the reel is attracted to an external object and provided to the audio-visual device for hanging.

Description of the Related Art

In general, when a user uses a computer, a loudspeaker is used to produce sound. In some special places, such as companies or Internet cafes, most users can wear headphones to listen to sound generated from computers. Even at dead of night, the user can also listen to the sound by headphones instead by loudspeakers, so as to avoid disturbing the others. For users, storage problems for circumaural phones or earphones often appear. As a result, many reels storing headphones are invented lest the problem with storing headphones appear when users do not use the headphones. For example, the headphone is freely arranged to entangle its cables, and thus it costs time to untangle and use the cables next time. Alternatively, the cables are seriously entangled to break inner metal lines of the cables, so that sound is not received or noise is generated.

With the technical advance, a head-mounted display is presently invented to replace a speaker producing sound and a display. When a user wears the head-mounted display, he will watch a picture and listen to sound. Cables of the head-mounted display are more complicated than those of a headphone. In addition to audio cables, visual signal cables are added. Besides, the cables of the head-mounted display are longer so that the user conveniently moves. For example, the cable of the head-mounted display has a length of 495 cm. As a result, when the user does not use the head-mounted display, the cables of the head-mounted display are not easily reeled by a common reel. Thus, the user cannot easily place the head-mounted display and spool its cables. Some computer mainframe is provided with a phone stand supporting a circumaural phone. The circumaural phone or the head-mounted display may be placed on the phone stand. However, the phone stand cannot reel their cables, so that the user bothers or uses the other tools to reel and manage cables. Over time, the user will hate to reel cables whereby the cables are disorderedly stored, thereby reducing the usage life of the devices.

To overcome the abovementioned problems, the present invention provides a cable reel for audio-visual device, so as to solve the problems with placing and reeling the head-mounted display and the headphone.

SUMMARY OF THE INVENTION

A primary objective of the present invention is to provide a cable reel for audio-visual device, which allows a user to conveniently place an audio-visual device and reel its cables. After using the audio-visual device, the user hangs the audio-visual device on the cable reel for audio-visual device and reels cables with one hand. The cable reel is very convenient for the user to place the audio-visual device and manage cables.

Another objective of the present invention is to provide a cable reel for audio-visual device, which freely moves according to requirement of a user. For example, the cable reel for audio-visual device is attracted to a side of an outer case of a computer mainframe or attracted to either a higher position or a lower position of the side. Alternatively, the reel is placed on a stand, so that the user conveniently stores the audio-visual device and its cables.

To achieve the abovementioned objectives, the present invention provides a cable reel for audio-visual device, which comprises an upper base and a lower base. A side of the upper base is annularly provided with an upper circular groove. The upper base is attracted to an external device, and a top of the upper base is provided to an audio-visual device for hanging. A side of the lower base is annularly provided with a lower circular groove. The lower base is attracted to the external device and arranged under the upper base. The lower base cooperates with the upper base whereby the upper circular groove and the lower circular groove accommodate connection cables of the audio-visual device spooled around the upper base and the lower base.

In the present invention, the lower base is selectively fastened with the upper base, so as to connect the lower base with the upper base. Then, the connection cables of the audio-visual device are accommodated in the upper circular groove and the lower circular groove connected. When the lower base is not fastened with the upper base, the connection cables of the audio-visual device are partially accommodated in the upper circular groove and the lower circular groove separating to each other.

Continuing from the abovementioned description, the upper base is fastened with the lower base by using fastening mother portions and fastening subportions. The fastening mother portion and the fastening subportion further comprise magnetic bodies with different polarities, which are helpful in fastening the upper base and the lower base.

In the present invention, the fastening mother portion and the fastening subportion further comprise magnetic bodies, so that the upper base and the lower base are attracted to an external device such as a computer mainframe or a metal shelf. If the computer mainframe has a non-metallic outer case, the non-metallic outer case is further provided with a metal body therein to favor attraction.

Below, the embodiments are described in detail in cooperation with the drawings to make easily understood the technical contents, characteristics and accomplishments of the present invention.

DETAILED DESCRIPTION OF THE INVENTION

With the technical advance, different products are produced to improve leisure activities of people. For example, a head-mounted display establishing virtual reality is manufactured, and provides a wider view angle when a user watches a video or plays a game. However, in order to make the user conveniently store the head-mounted display, the present invention provides a cable reel for audio-visual device different from a conventional technology.

Figure 1:
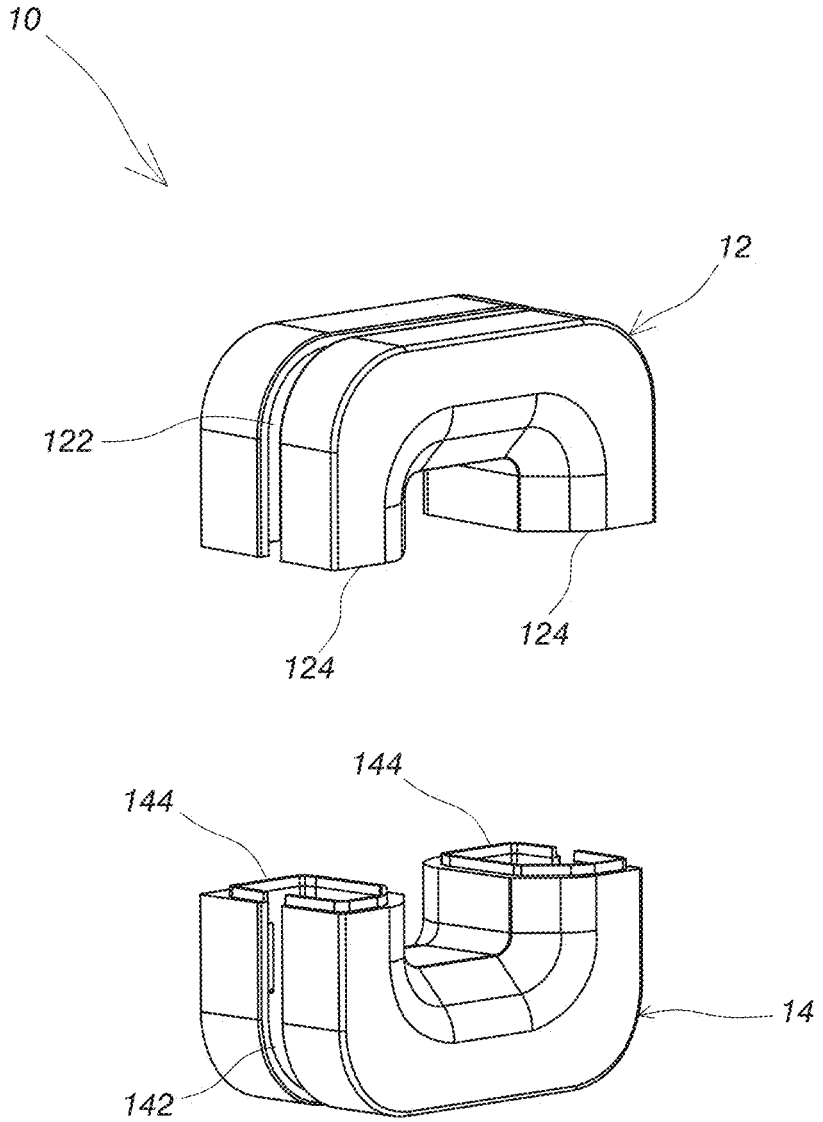
FIG. 1 is a perspective view of an upper base and a lower base when separating according to an embodiment of the present invention.
Figure 2:
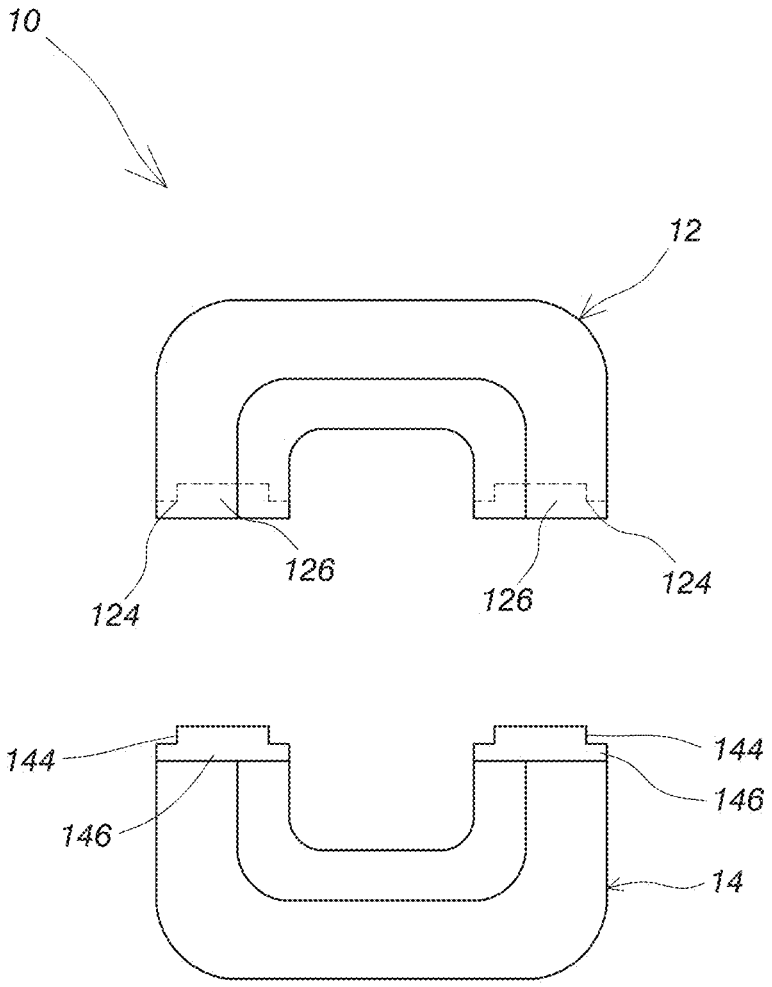
FIG. 2 is a front view of an upper base and a lower base when separating according to an embodiment of the present invention.
Figure 3:
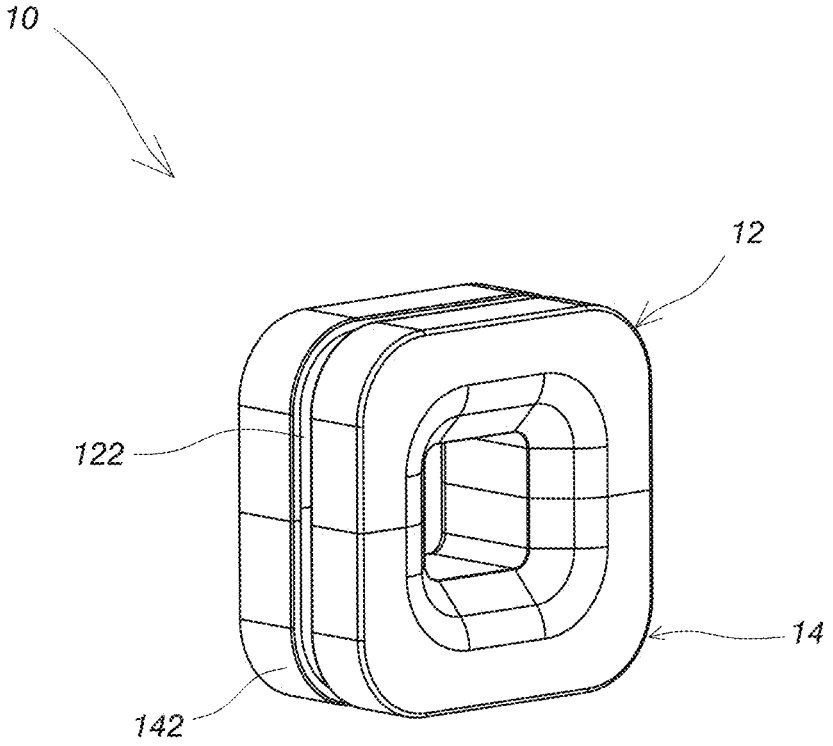
FIG. 3 is a perspective view of an upper base and a lower base when combined according to an embodiment of the present invention.

Refer to FIG. 1, FIG. 2 and FIG. 3. A cable reel 10 for audio-visual device comprises an upper base 12 and a lower base 14. An outer side of the upper base 12 is annularly provided with an upper circular groove 122. An outer side of the lower base 14 is annularly provided with a lower circular groove 142. In the embodiment, the upper circular groove 122 and the lower circular groove 142 are made of soft material. Each of the upper circular groove 122 and the lower circular groove 142 has a shape of U. A bottom of the upper base 12 is further provided with at least two fastening mother portions 124. A top of the lower base 14 is correspondingly provided with at least two fastening subportions 144. In the embodiment, the upper base 12 is provided with two fastening mother portions 124, and the lower base 14 is correspondingly provided with two fastening subportions 144. Each of the fastening mother portions 124 on the upper base 12 further comprises a magnetic body 126. Each of the fastening subportions 144 on the lower base 14 further comprises a magnetic body 146. The polarity of magnetic body 126 is different from that of the magnetic body 146. The appearance of cable reel 10 for audio-visual device is shown in FIG. 1 or FIG. 3. As shown in FIG. 1, the upper base 12 and the lower base 14 separate. As shown in FIG. 3, the upper base 12 is fastened with the lower base 14 by using the fastening mother portion 124, the fastening subportion 144, the magnetic body 126 and the magnetic body 146, whereby the upper base 12 is combined with the lower base 14. Then, refer to FIG. 4. The upper base 12 further comprises a first magnetic body 128, and the lower base 14 further comprises a second magnetic body 148. In the embodiment, the first magnetic body 128 is arranged in the back of the upper base 12, and the second magnetic body 148 is arranged in the back of the lower base 14.

Figure 4:
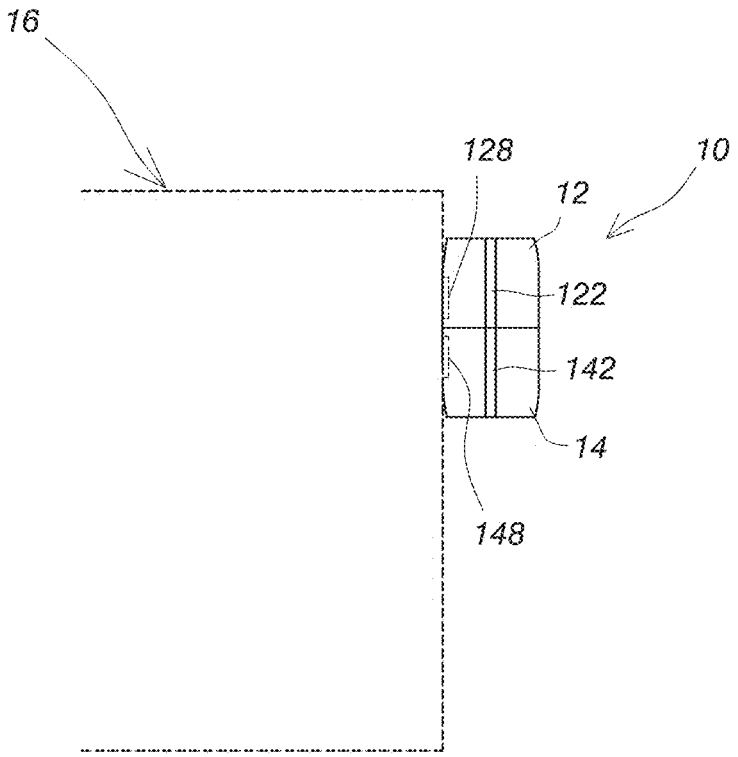
FIG. 4 is a side view of an upper base and a lower base combined and attracted to an external device according to an embodiment of the present invention.
Figure 5:
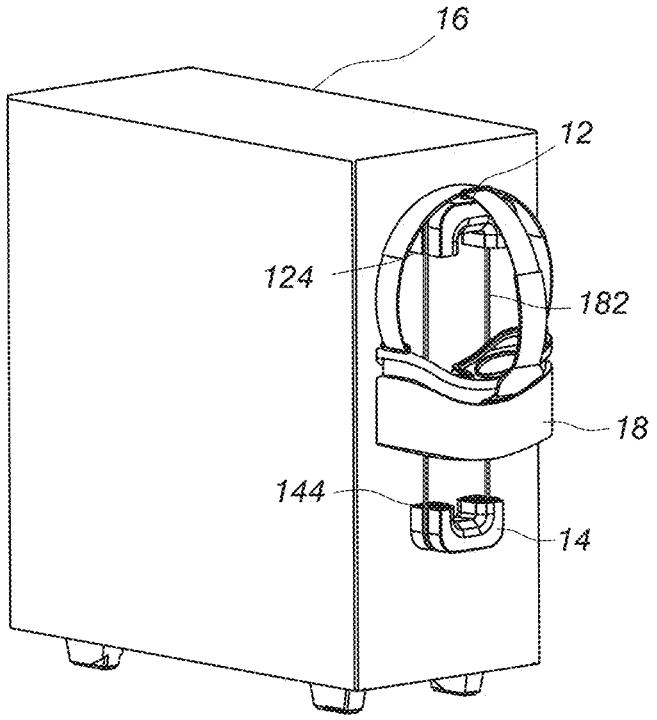
FIG. 5 is a perspective view of a cable reel for audio-visual device used in the first way according to an embodiment of the present invention.
Figure 6:
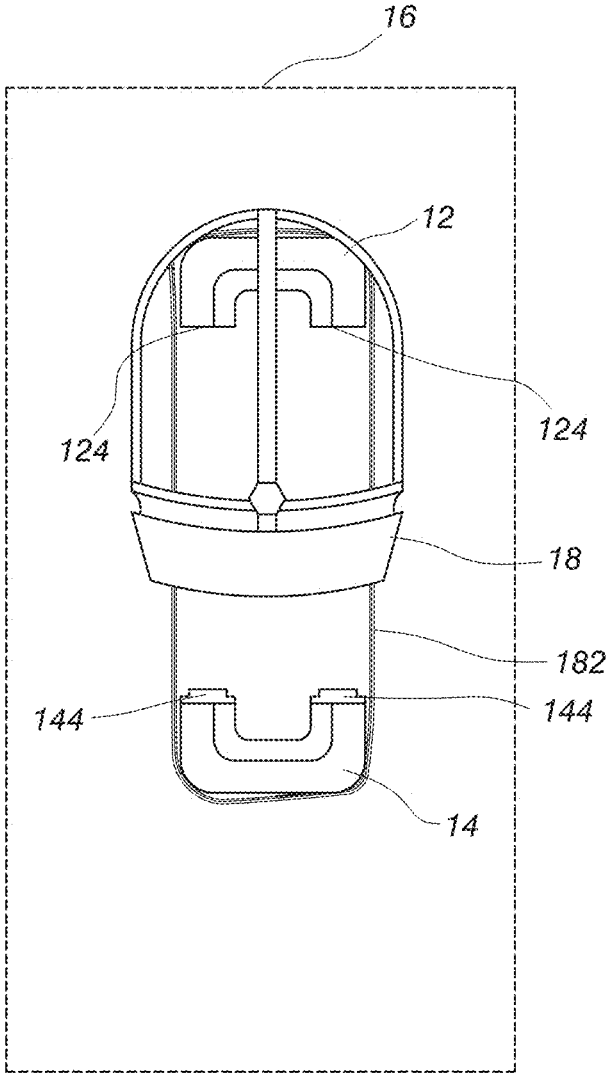
FIG. 6 is a front view of a cable reel for audio-visual device used in the first way according to an embodiment of the present invention.
Figure 11:
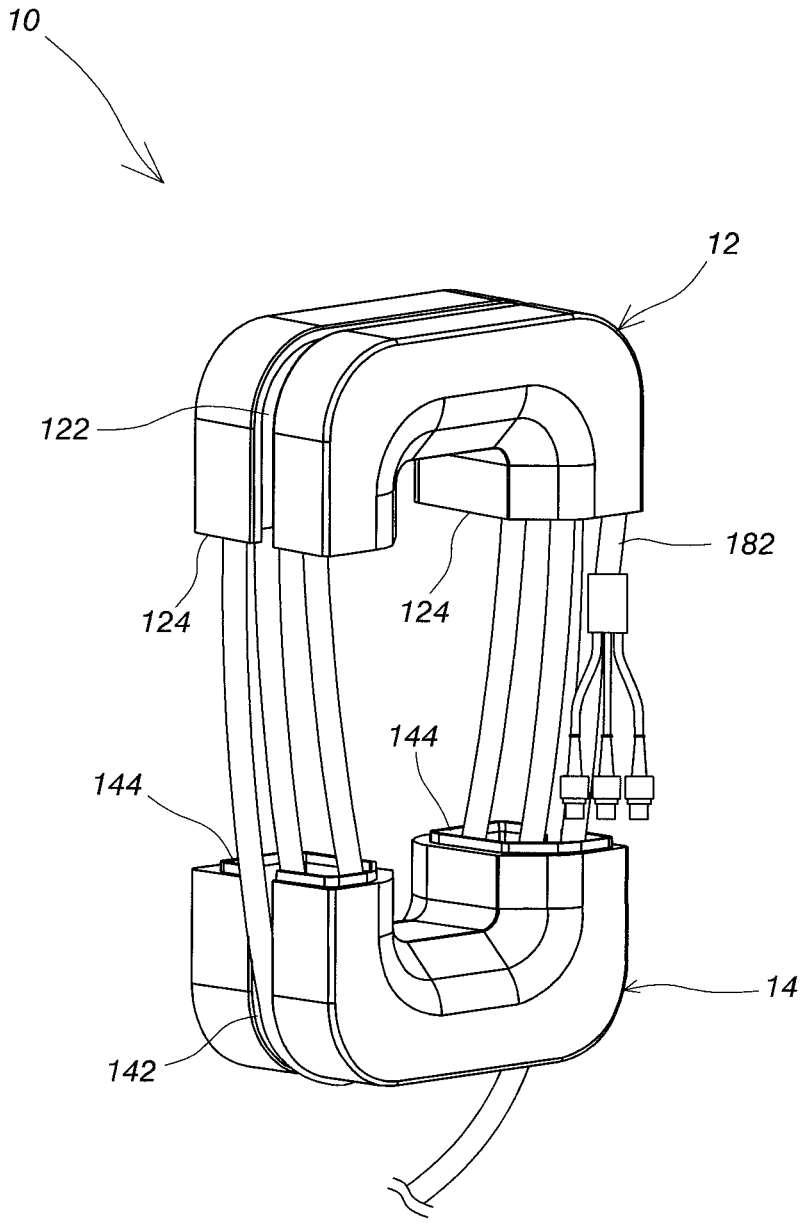
FIG. 11 is a perspective view of a cable reel with a cable according to an embodiment of the present invention.

After explaining the structure of the present invention, how to use the present invention is described as below. Refer to FIG. 4, FIG. 5 and FIG. 6. The upper base 12 is attracted to an external device 16 by using the first magnetic body 128. An audio-visual device 18 hangs on the top of the upper base 12. The lower base 14 is attracted to the external device 16 by using the second magnetic body 148 and arranged under the upper base 12. In the embodiment, the external device 16 is a computer mainframe. The audio-visual device 18 is a head-mounted display for virtual reality (VR). After the experiment of the inventor of the present invention, the first magnetic body 128 is a strong magnet that can support an object having a weight of 1.5 kg, so as to effectively hang the audio-visual device 18 such as a head-mounted display. Connection cables 182 of the audio-visual device 18 hanging on the upper base 12 are spooled around the upper base 12 and the lower base 14, whereby the connection cables 182 can partially accommodated in the upper circular groove 122 and the lower circular groove 142. The soft material of the upper circular groove 122 and the lower circular groove 142 can avoid damaging the connection cables 182 when a user stuffs the connection cables 182 into the upper circular groove 122 and the lower circular groove 142. In the embodiment, the connection cables 182 are audio cables of a head-mounted display or three-in-one cables (HDMI cable, USB cable and power cable). See also FIG. 11.

Figure 7:
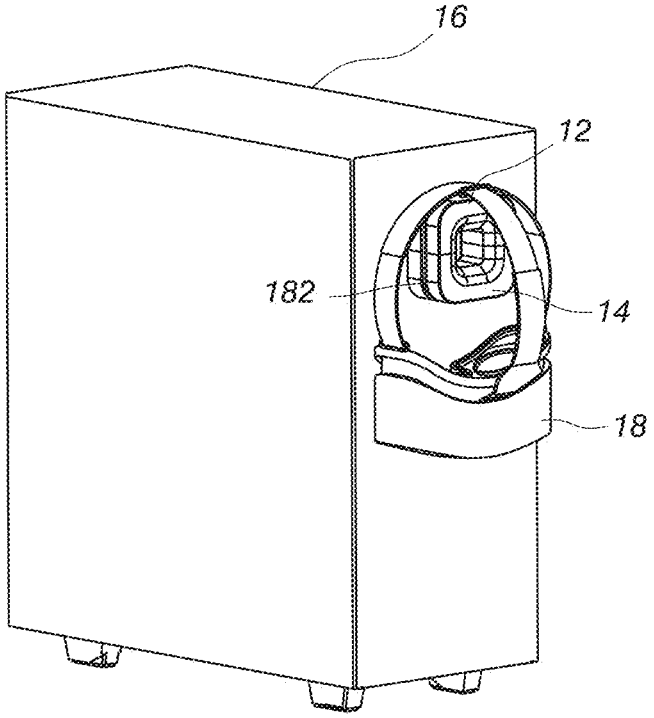
FIG. 7 is a perspective view of a cable reel for audio-visual device used in the second way according to an embodiment of the present invention.
Figure 8:
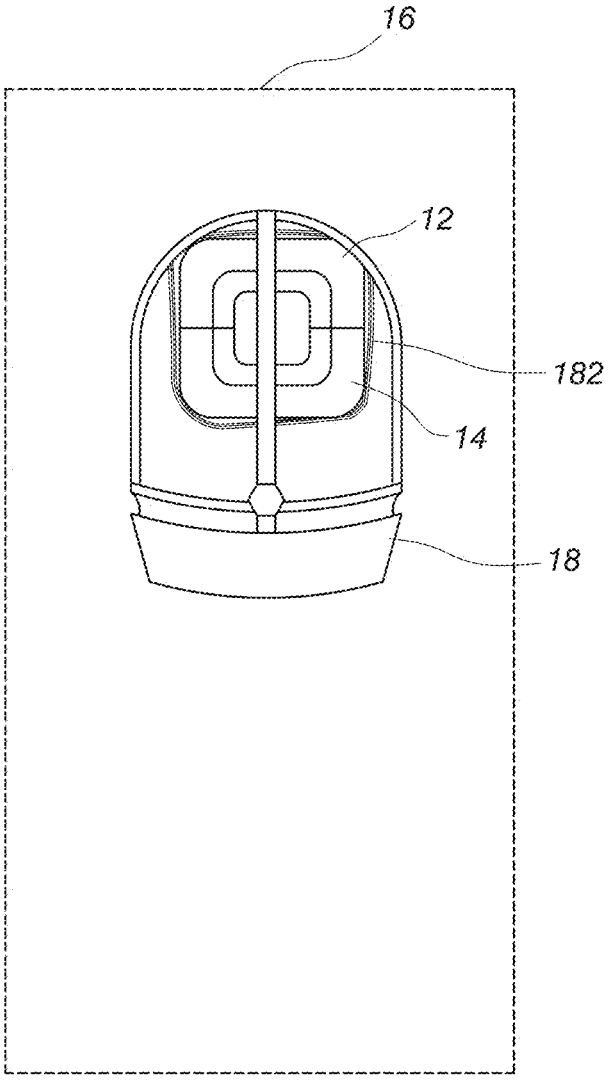
FIG. 8 is a front view of a cable reel for audio-visual device used in the second way according to an embodiment of the present invention.

In the abovementioned embodiment, when the upper base and the lower base separate, the upper base is an appropriate distance from the lower base according to the requirement of the user, so that the user spools the connection cables around the upper base and the lower base. Then, the present invention provides another embodiment. Refer to FIG. 4, FIG. 7 and FIG. 8. If the connection cables 182 of the audio-visual device 18 used by the user are not too long and a spooling range required by the connection cables 182 is not too large, the user can fasten the fastening mother portion 124 of the upper base 12 to the fastening subportion 144 of the lower base 14, whereby the upper base 12 is combined with the lower base 14 to connect the upper circular groove 122 of the upper base 12 with the lower circular groove 142 of the lower base 14. Then, the user can spool the connection cables 182 of the audio-visual device 18 around the upper base 12 and the lower base 14, whereby the connection cables 182 are accommodated in the upper circular groove 122 and the lower circular groove 142 connected.

Figure 9:
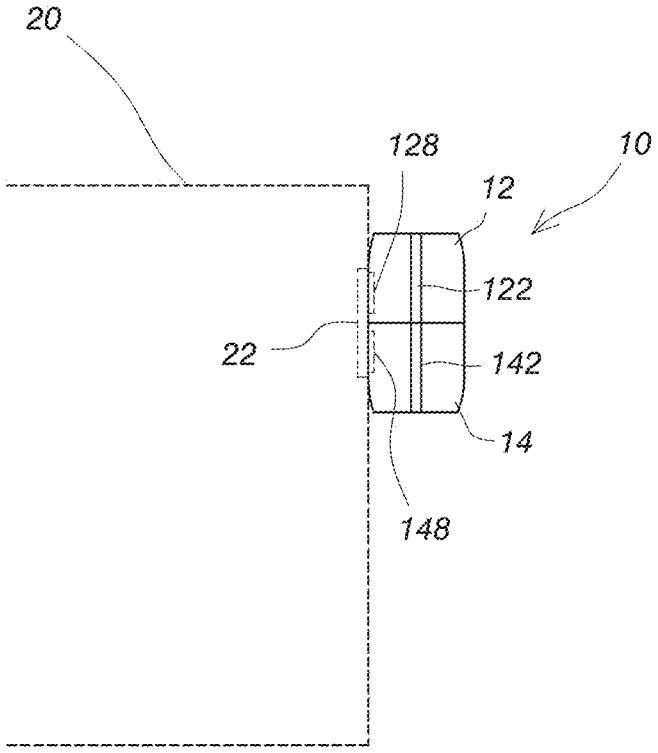
FIG. 9 is a side view of an upper base and a lower base combined and attracted to a non-metallic outer case according to an embodiment of the present invention.

The upper base and the lower base which are fastened or separated are attracted to an outer case of the computer mainframe. Most of the outer cases are made of metal. The upper base and the lower base are easily attracted to the outer case made of metal. The present invention further provides an embodiment to apply to a non-metallic outer case. Refer to FIG. 9. When the computer mainframe 20 used as the external device has a non-metallic outer case, the computer mainframe 20 further comprises a metal body 22, which corresponds to the position that the upper base 12 and the lower base 14 are attracted to the computer mainframe 20. The metal body 22 is arranged in the non-metallic outer case of the computer mainframe 20, such that the first magnetic body 128 and the second magnetic body 148 are attracted to the non-metallic outer case of the computer mainframe 20. The upper base 12 is fastened with the lower base 14 in FIG. 9, but the present invention is not limited thereto. The user can add the amount of the metal body 22 according to requirement. In the present invention, at least one metal body 22 is also used. If the connection cables are too long and the user needs to separate the upper base from the lower base, the user adds the amount of the metal body to attract the upper base and the lower base. For example, each of the upper base and the lower base has a metal body to attract the non-metallic outer case.

The present invention does not limit whether the upper base and the lower base are combined or separated. In addition, the present invention does not limit the fastening structures used by the upper base and the lower base when combined. FIG. 2 of the present invention discloses the shapes of the fastening mother portions and the fastening subportions, but the present invention is not limited thereto. The present invention also combines the upper base with the lower base without the fastening mother portions and the fastening subportions. For example, the magnetic bodies such as strong magnets are used to combine the upper base with the lower base. Alternatively, by using the attraction of the upper base and the lower base for the external device, the upper base is close to the lower base on the external device. As a result, all the ways to combine the upper base with the lower base are also included in the scope of the present invention. The present invention is mainly used to hang an audio-visual device such as a head-mounted display, so as to store longer connection cables. Additionally, the user also uses the present invention to store a common circumaural phone. The circumaural phone hangs on the upper base, and the connection cables used as audio cables are spooled around the upper base and the lower base and accommodated in the upper circular groove and the lower circular groove. Since the weight of the circumaural phone is less than that of the head-mounted display and the circumaural phone has shorter connection cables, there is nothing wrong when the user stores the circumaural phone.

Figure 10A:
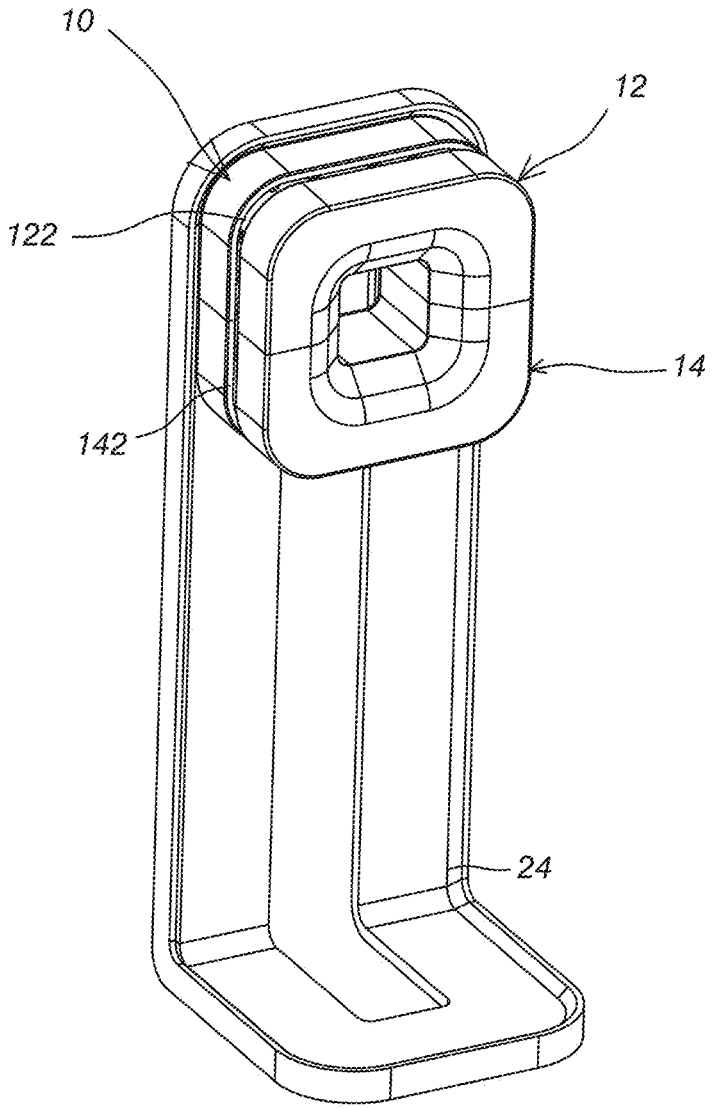
FIG. 10*a* and FIG. 10*b* are perspective views of a cable reel for audio-visual device arranged on a metal shelf according to an embodiment of the present invention.
Figure 10B:
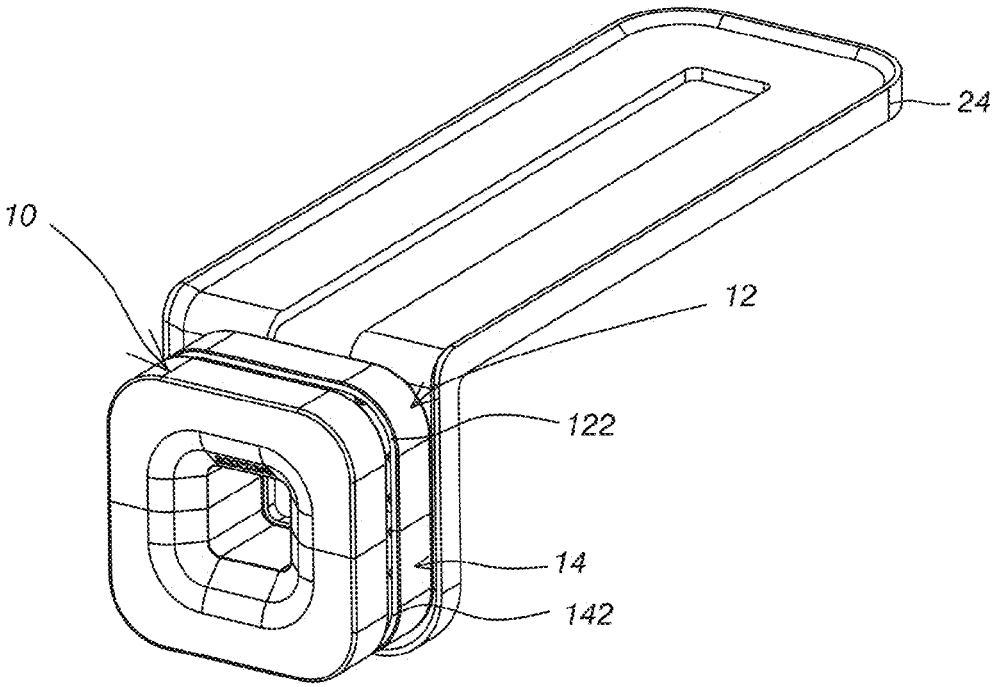

Besides, there is also nothing wrong when the user spools the connection cables of the circumaural phone around the upper base and the lower base and accommodates the cables in the upper circular groove and the lower circular groove. The user can easily use the present invention to spool connection cables of various audio-visual devices around the upper base and the lower base and accommodate the connection cables in the upper base and the lower base with one hand. It is not necessary to attract the cable reel for audio-visual device of the present invention to the computer mainframe. If the position of the computer mainframe is inconvenient for the user to attract the cable reel for audio-visual device, the user attracts the cable reel 10 for audio-visual device to a metal shelf 24, as shown in FIG. 10*a* and FIG. 10*b*. For example, the metal shelf 24 is vertically placed on a computer desk, and then the cable reel 10 for audio-visual device is attracted to the metal shelf 24 vertically arranged, as shown in FIG. 10*a*. In such a case, the cable reel 10 for audio-visual device separates the upper base 12 from the lower base 14 to store an audio-visual device, such as a headphone or a head-mounted display. Alternatively, the user places the metal shelf 24 on a position near the computer mainframe. For example, the metal shelf 24 is locked under the computer desk. As shown in FIG. 10*b*, the user locks the metal shelf 24 under the computer desk by locking members such as screws. Then, the cable reel 10 for audio-visual device is attracted to the metal shelf 24. The present invention does not limit the position and structure of the metal shelf 24. The metal shelf 24 is placed according to preference of the user. The figures do not also limit shape of the metal shelf 24. The present invention mainly provides the cable reel which is convenient for the user to store the audio-visual device, whereby the user can easily spool the connection cables around the cable reel with one hand.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A cable reel for audio-visual device comprising:

an upper base with a side thereof annularly provided with an upper circular groove, and said upper base is attracted to an external device, and a top of said upper base is provided to an audio-visual device for hanging; and a lower base with a side thereof annularly provided with a lower circular groove, and said lower base is attracted to said external device and arranged under said upper base, and said lower base cooperates with said upper base whereby said upper circular groove and said lower circular groove accommodate connection cables of said audio-visual device spooled around said upper base and said lower base, wherein said lower base is selectively fastened with said upper base, and when said lower base is fastened with said upper base to connect said upper circular groove with said lower circular groove, said connection cables of said audio-visual device are accommodated in said upper circular groove and said lower circular groove connected, and when said lower base is not fastened with said upper base, said connection cables of said audio-visual device are partially accommodated in said upper circular groove and said lower circular groove separating to each other.

2. The cable reel for audio-visual device according to claim 1, wherein a bottom of said upper base is further provided with at least two fastening mother portions, and said a top of said lower base is further provided with at least two fastening subportions, and said upper base is fastened with said lower base by using said fastening mother portions and said fastening subportions.

3. The cable reel for audio-visual device according to claim 2, wherein each of said at least two fastening mother portions and said at least two fastening subportions further comprises at least one magnetic body, and polarities of said at least two magnetic bodies of said at least two fastening mother portions are different from polarities of said at least two magnetic bodies of said at least two fastening subportions.

4. The cable reel for audio-visual device according to claim 1, wherein said upper base further comprises a first magnetic body, and said lower base further comprises a second magnetic body, and said upper base and said lower base are attracted to said external device by using said first magnetic body and said second magnetic body.

5. The cable reel for audio-visual device according to claim 4, wherein said external device is a computer mainframe or a metal shelf.

6. The cable reel for audio-visual device according to claim 5, wherein said computer mainframe has a non-metallic outer case, and said computer mainframe further comprises at least one metal body arranged in said non-metallic outer case of said computer mainframe, and said first magnetic body and said second magnetic body are attracted to said non-metallic outer case by using said at least one metal body.

7. The cable reel for audio-visual device according to claim 1, wherein audio-visual device is a head-mounted display for virtual reality or a headphone.

8. The cable reel for audio-visual device according to claim 1, wherein said connection cables are audio cables or three-in-one cables.

9. The cable reel for audio-visual device according to claim 8, wherein the three-in-one-cables include an HDMI cable, a USB cable and a power cable.

* * * * *